US006710763B1

(12) United States Patent
Iinuma

(10) Patent No.: US 6,710,763 B1
(45) Date of Patent: Mar. 23, 2004

(54) DISPLAY CONTROL METHOD AND DISPLAY CONTROLLER

(75) Inventor: Takaaki Iinuma, Tokyo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 231 days.

(21) Appl. No.: 09/649,976

(22) Filed: Aug. 29, 2000

(30) Foreign Application Priority Data

Aug. 31, 1999 (JP) ..... P. 11-246158
Nov. 24, 1999 (JP) ..... P. 11-332937

(51) Int. Cl.[7] ..... G09G 3/36
(52) U.S. Cl. ..... 345/102; 345/74; 315/169.3
(58) Field of Search ..... 345/63, 102, 214, 345/77; 315/169.9, 169.3

(56) References Cited

U.S. PATENT DOCUMENTS 4,355,334 A 10/1982 Fitzgibbon et al.
4,368,406 A 1/1983 Kruzich et al.
4,414,493 A 11/1983 Henrich
4,697,122 A 9/1987 Hoffer
4,760,389 A * 7/1988 Aoki et al. ..... 345/102
4,917,477 A 4/1990 Bechtel et al.
5,402,040 A 3/1995 Sprout
5,406,305 A * 4/1995 Shimomura et al. ..... 345/102
5,428,265 A 6/1995 Booth, Jr. et al.
5,581,158 A 12/1996 Quazi
5,677,701 A 10/1997 Okuyama et al.
5,742,131 A 4/1998 Sprout et al.
5,818,553 A * 10/1998 Koenck et al. ..... 345/102
5,883,605 A 3/1999 Knapp
6,069,597 A * 5/2000 Hansen ..... 315/169.1
6,069,598 A * 5/2000 Hansen ..... 345/74.1
6,265,833 B1 * 7/2001 Kim et al. ..... 315/149

FOREIGN PATENT DOCUMENTS

JP 5-88657 4/1993
JP 10-282923 10/1998

* cited by examiner

*Primary Examiner*—Amare Mengistu
(74) *Attorney, Agent, or Firm*—Pearne & Gordon LLP

(57) ABSTRACT

In a dimmer control technique of the invention, the outside light detection period is made variable and the intensity adjustment speed is changed and is made variable so as to deal with outside light change in largely different use environments, such as the inside of a room and the inside of a moving car. Cases are preset, outside light is converted into a voltage for each representative environment condition, the provided voltage is read by a microcomputer as input voltage, intensity control is performed, the relationship between the read period data and the reference voltage to be compared therewith is stored in a storage unit such as non-volatile memory, and data is fetched from the storage unit for performing control.

11 Claims, 7 Drawing Sheets

DISPLAY CONTROL METHOD AND DISPLAY CONTROLLER

BACKGROUND OF THE INVENTION

1. Field of the Invention

This invention relates to a display and a display control method and in particular to a dimmer control technique wherein outside light is converted into a voltage by a photosensor and an intensity indication voltage is read by a microcomputer for controlling the intensity of an in-car image display.

2. Description of the Related Arts

Since the brightness in an automobile changes largely depending on the environment outside the automobile, the intensity needs to be finely changed in an in-car display such as a display of a car navigation system.

In some countries, this kind of dimmer control is made compulsory.

A dimmer control technique in a related art will be discussed.

The dimmer control in the related art is adapted to change intensity L stepwise with respect to input voltage V, as shown in FIG. 7 (schematic representation of the principle of the dimmer control). In FIG. 7, the horizontal axis is the input voltage V and the vertical axis is the intensity L. However, hysteresis is provided in accordance with the solid line characteristic when the voltage rises, and is provided so as to provide the dashed line characteristic when the voltage falls. For example, if the voltage V exceeds V2, the intensity L is raised by one step from L1 to L2, but if the voltage V falls below V2, L2 is maintained on the characteristic curve indicated by the dashed line until the voltage V becomes V1 or less. If the voltage V exceeds V2, the intensity L remains to be L2 until the voltage V exceeds V3. Thus, after all, a hysteresis width is formed one step at a time above and below with V2 as the center and processing is performed so as not to cause intensity variation to occur for ripples in the range.

By the way, the accuracy required for intensity adjustment when the vehicle is driven on a flat highway, etc., where the surrounding environment less changes largely differs that when the vehicle is driven on an uneven mountain path, etc., where the surrounding environment largely changes. That is, to drive the vehicle on the highway, the light amount detection period is taken large, such as 30 minutes or one hour, and the intensity adjustment frequency may be small; to drive the vehicle on the mountain path, the light amount detection period needs to be made small for executing intensity adjustment frequently.

Rapid change in the light quantity may be received in some cases, such as reception of intermittently irregularly reflected light in the presence of a handrail, etc., rapid change when the vehicle enters a tunnel, or instantaneous light from an oncoming vehicle at the night driving time. In such cases, if the intensity of the display is adjusted in response to the instantaneous light amount, in fact the intensity adjustment speed of the dimmer does not follow and the display may enter a state hard to see.

There is a tendency to grow the display function of a display of a portable telephone with the increasing range of uses for mail, etc. Such a portable telephone may be used in various external environments. Change in outside light to use the portable telephone outside differs largely from that to use the portable telephone indoors. For example, to use the portable telephone indoors, outside light change does not occur for hours if the portable telephone is used at the same place under night illumination. In contrast, to use the portable telephone outside and moreover in a moving train, bus, etc., outside light change is extremely large.

However, in the method in the related art, the outside light detection period is constant; adjustments are made in the same period regardless of the use place of the portable telephone, namely, in the room where adjustment is not required for hours or in a moving car where the external environment changes frequently. If the period is made too small, the adjustment variable value is constant and variations in intensity adjustment speeds from one product to another cannot be absorbed and in contrast, if the detection period is taken large, sufficient adjustment cannot be made; this is a problem.

To use the portable telephone indoors, even the adjustment frequency in hour units of detection period is sufficient because outside light change is extremely small.

SUMMARY OF THE INVENTION

It is therefore a first object of the invention to provide a display control method capable of changing the adjustment frequency in response to the use environment.

It is a second object of the invention to absorb variations from one product to another and intermittent change in outside light and provide good intensity adjustments. To the ends, in the dimmer control technique of the invention, the outside light detection period is made variable and the intensity adjustment speed is changed and is made variable so as to deal with outside light change in largely different use environments, such as the inside of a room and the inside of a moving car.

When light amount change of outside light is not held a constant value or more for a constant time, even if the outside light changes, the preceding value of intensity is maintained, thereby absorbing intermittent change in the outside light caused by a handrail, etc.

According to a first aspect of the invention, there is provided a display control method for adjusting intensity of an image display in accordance with time change of outside light, the display control method comprising the steps of detecting the light amount of the outside light and adjusting the intensity in response to the detected light amount, characterized in that the detecting step comprises the variable period setting step of setting a read period and the detecting step of detecting the light amount every period set at the setting step.

According to the Configuration, appropriate intensity adjustment can be made in response to the use environment and an easy-to-see display image can be provided. For example, with a portable telephone, change in outside light to use the portable telephone outside differs largely from that to use the portable telephone indoors. In such a case, for example, to use the portable telephone indoors, the read period is set large, such as one hour or two hours; to use the portable telephone outside and moreover in a moving train, bus, etc., the period is lessened, so that it is made possible to control in response to the use environment.

According to a second aspect of the invention, there is provided a display control method for adjusting intensity of an image display in accordance with time change of outside light, the display control method comprising the steps of detecting the light amount of the outside light and adjusting the intensity in response to the detected light amount, characterized in that the detecting step comprises the processing step of changing the intensity only if light amount change of the outside light is held a constant value or more for a constant time, thereby absorbing intermittent change in the outside light.

According to the method, if abrupt change of intermittent irregular reflection caused by a handrail, etc., noise, or the like is detected, no intensity adjustment is made and only when the light amount change of the outside light holds the difference of a constant value or more for a constant time, the intensity is changed, so that it is made possible to make stable intensity adjustments. If the follow speed of a speed adjustment actuator is small because of the machine system difference of the used apparatus, the constant time can also be prolonged and resistance to adjustment is also enabled.

In a third aspect of the invention, in the display control method as claimed in claim 2, the detecting step comprises the additional steps of the variable period setting step of further setting a read period.

In a fourth aspect of the invention, in the display control method as claimed in claim 1, further comprising the processing step of changing the intensity only if light amount change of the outside light is held a constant value or more for a constant time, thereby absorbing intermittent change in the outside light.

According to the method, in addition to the advantage provided according to the first aspect of the invention, if abrupt change of intermittent irregular reflection caused by a handrail, etc., noise, or the like is detected, no intensity adjustment is made and only when the light amount change of the outside light is held a constant value or more for a constant time, the intensity is changed, so that it is made possible to make stable intensity adjustments.

In a fifth aspect of the invention, in the display control method as claimed in claim 1, the detecting step comprises the additional step of executing photoelectric conversion of the light amount of the outside light to a voltage value and outputting the light amount as the voltage value.

In a sixth aspect of the invention, in the display control method as claimed in claim 1, the variable period setting step is to read data from among data stored in a storage unit and set the read data as the read period.

According to the configuration, appropriate periods are preset in response to several situation settings and an appropriate adjustment mode can be easily set simply by selecting a situation. For example, cases are preset, outside light is converted into a voltage for each representative environment condition, the provided voltage is read by a microcomputer as input voltage, intensity control is performed, the relationship between the read period data and the reference voltage to be compared therewith is stored in a storage unit such as non-volatile memory, and data is fetched from the storage unit for performing control. In doing so, control is facilitated. Using flash memory, data can be fetched and used instantaneously and it is made possible to perform intensity control with higher accuracy.

In a seventh aspect of the invention, in the display control method as claimed in claim 2, the detecting step comprises the additional step of executing photoelectric conversion of the light amount of the outside light to a voltage value and outputting the light amount as the voltage value.

In an eighth aspect of the invention, in the display control method as claimed in claim 2, the variable period setting step is to read data from among data stored in a storage unit and set the read data as the read period.

In a ninth aspect of the invention, in the display control method as claimed in claim 2, the display is an in-car display.

According to a tenth aspect of the invention, there is provided a display controller comprising variable period setting means for setting a read period, detection means for detecting the light amount of outside light every setup read period, and intensity adjustment means for adjusting intensity of a display in response to the detected light amount of outside light.

According to an eleventh aspect of the invention, there is provided a display controller comprising detection means for detecting the light amount of outside light and intensity adjustment means for adjusting intensity of a display in response to the detected light amount of outside light, characterized in that the intensity adjustment means adjusts the intensity only if light amount change of the outside light is held a constant value or more for a constant time, thereby absorbing intermittent change in the outside light.

In a twelfth aspect of the invention, in the display controller as claimed in claim 10, characterized in that the intensity adjustment means adjusts the intensity only if light amount change of the outside light is held a constant value or more for a constant time, thereby absorbing intermittent change in the outside light.

In a thirteenth aspect of the invention, in the display controller as claimed in claim 10, characterized in that the detecting means comprises the additional means of executing photoelectric conversion of the light amount of the outside light to a voltage value and outputting the light amount as the voltage value.

In a fourteenth aspect of the invention, in the display controller as claimed in claim 10, the variable period setting means is to read data from among data stored in a storage unit and set the read data as the read period.

In a fifteenth aspect of the invention, in the display controller as claimed in claim 10, the display is an in-car display.

DESCRIPTION OF THE PREFERRED EMBODIMENTS

Figure 1:
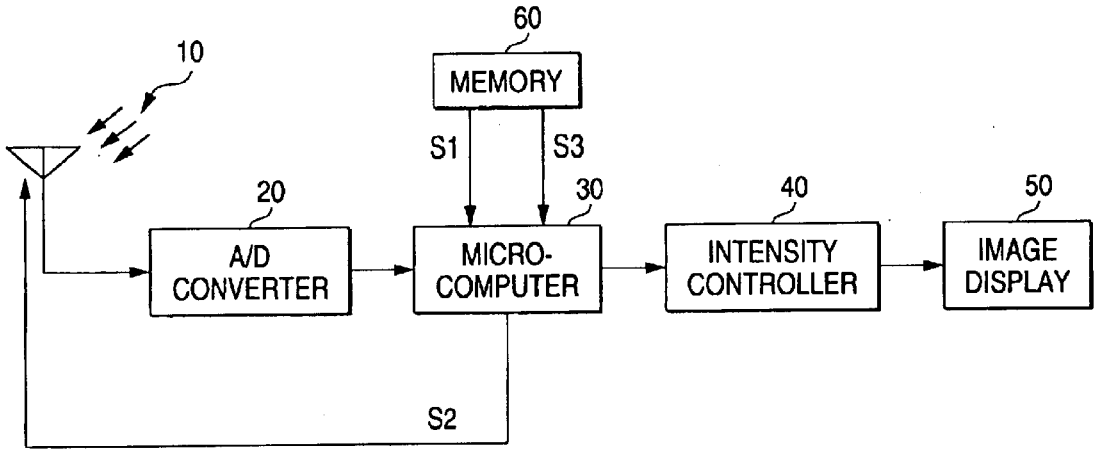
FIG. 1 is a block diagram of an in-car image display to show a first embodiment of the invention.

An in-car image display of a first embodiment of the invention is used as a display of a car navigation system. As shown in FIG. 1 (block diagram), the in-car image display comprises a photosensor 10 for detecting outside light, an A/D converter 20 for converting output of the photosensor 10 into a digital value, a microcomputer 30 for reading the digital value output by the A/D converter 20 and controlling an intensity controller to adjust the intensity of image display, intensity controller (such as signal processing LSI) 40 for controlling the image display based on a control signal of the microcomputer 30, and image display 50 controlled by the described mechanism. Memory (for example, nonvolatile memory) 60 storing data indicating the optimum read period in response to various situations is connected to the microcomputer 30. In the memory 60, an external environment is set, whereby an execution signal S2 is output through the microcomputer 30 by a period data signal S1 for setting the read period based on the environment, thereby controlling the photosensor 10.

Time data for absorbing intermittent change in outside light by changing the intensity only when the light amount change of the outside light is held a constant value or more for a constant time is also stored in the memory 60. By external setting, a time data signal S3 is output from the memory 60 and the microcomputer 30 can control the intensity controller 40 in response to the signal. The image display is, for example, a liquid crystal display and has intensity adjustment made by controlling voltage supplied to a backlight.

Figure 2:
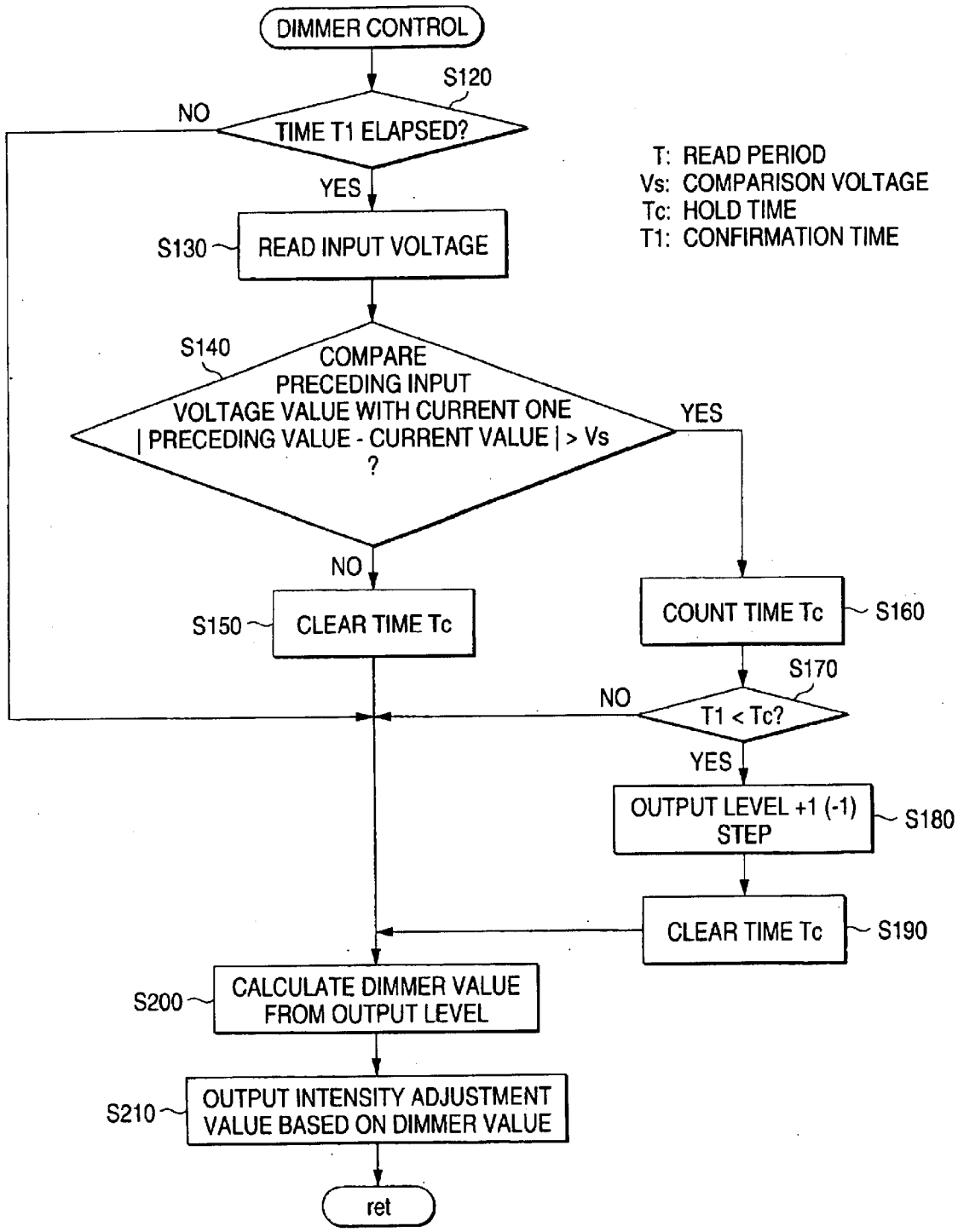
FIG. 2 is a flowchart to show an intensity adjustment process.

FIG. 2 is a flowchart of intensity adjustment to show one embodiment of the invention. A read period T and hold time Tc are preset in the memory 60 depending on the use environment. The read period T is thus adjusted and changed in response to the use environment, whereby the adjustment speed of the intensity in accordance with outside light can be adjusted. The hold time Tc is set, whereby the absorption degree of intermittent change in outside light can be adjusted.

First, as step S120, whether or not the read period T has elapsed is determined and if it is determined that the setup read period T has elapsed, control goes to step S130 at which input voltage is read.

Next, at step S140, the preceding input voltage value is compared with the current input voltage value and if it is determined that the voltage difference therebetween is within a comparison voltage Vs, control goes to step S150 at which the hold time Tc is cleared. On the other hand, it is determined at step S140 that the voltage difference is equal to or greater than the comparison voltage Vs, control goes to step S160 at which the hold time Tc is counted.

Further, at step S170, whether or not the hold time Tc exceeds confirmation time T1 is determined and if it is determined that the hold time Tc exceeds the confirmation time T1, control goes to step S180 at which the output level is incremented (decremented) by one. Then, at step S190, the hold time Tc is cleared.

Next, at step S200, control data (control voltage) for controlling the intensity controller 40 from the microcomputer 30 is calculated based on the output level, thereby finding a dimmer value. At step S210, an intensity adjustment value is output based on the dimmer value.

Figure 3:
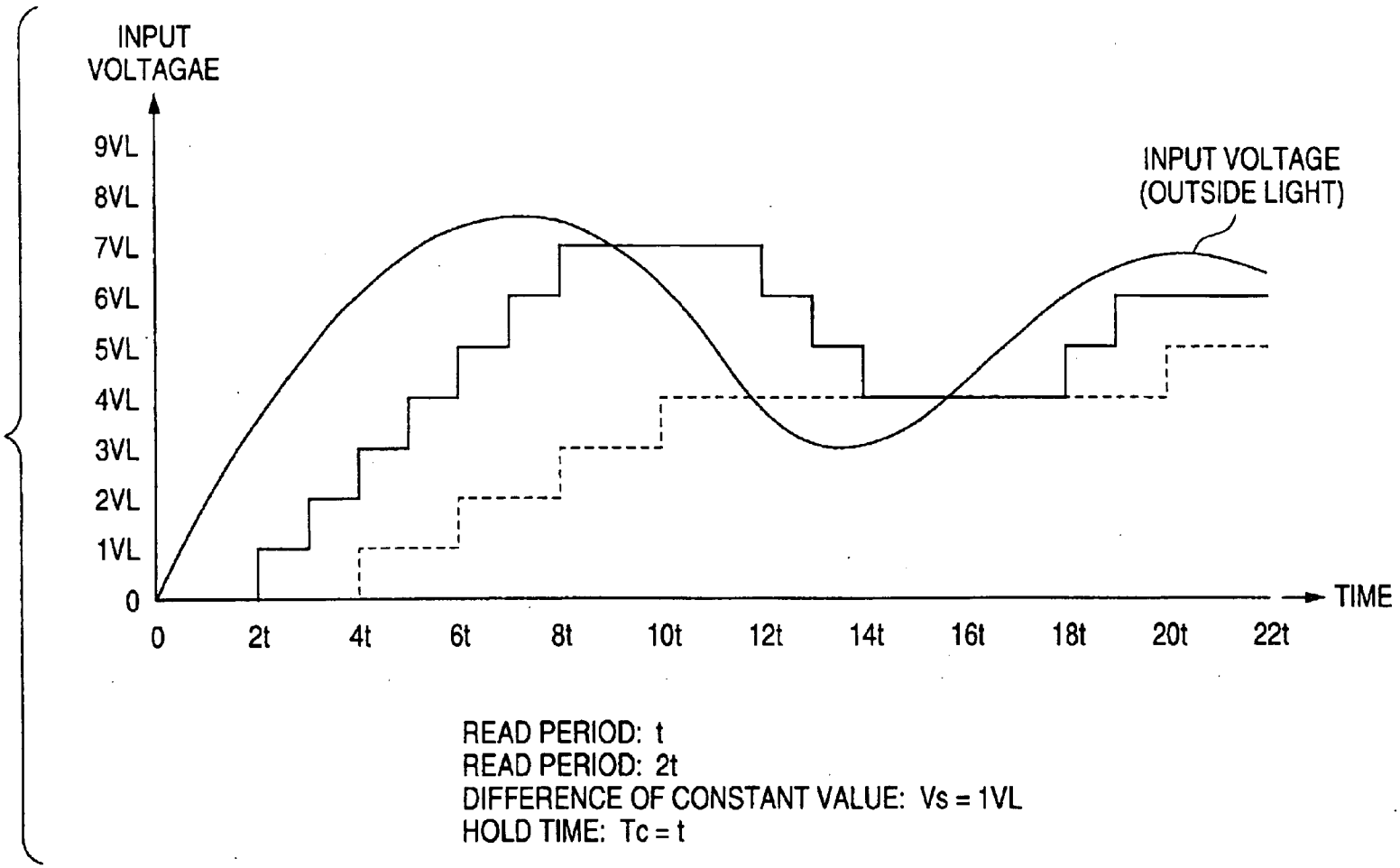
FIG. 3 is a chart to show an intensity adjustment characteristic in accordance with period.

Intensity adjustment is thus made for the input voltage, whereby intermittent change in the outside light caused by a handrail, etc., can be absorbed. FIG. 3 is an intensity adjustment characteristic chart relative to the read period. Here, the vertical axis indicates the input voltage, which corresponds to the voltage change amount caused by the outside light, Vs (1VL, 2VL, . . . ). The solid line indicates a characteristic chart with read period t and the dashed line indicates a characteristic charge with the read period set to 2t. Here, t is set to about one second.

Thus, the voltage read period T is changed, whereby the adjustment speed of the intensity relative to the outside light can be adjusted. The period is thus made variable, whereby it is made possible to absorb variations from one product to another.

Figure 4:
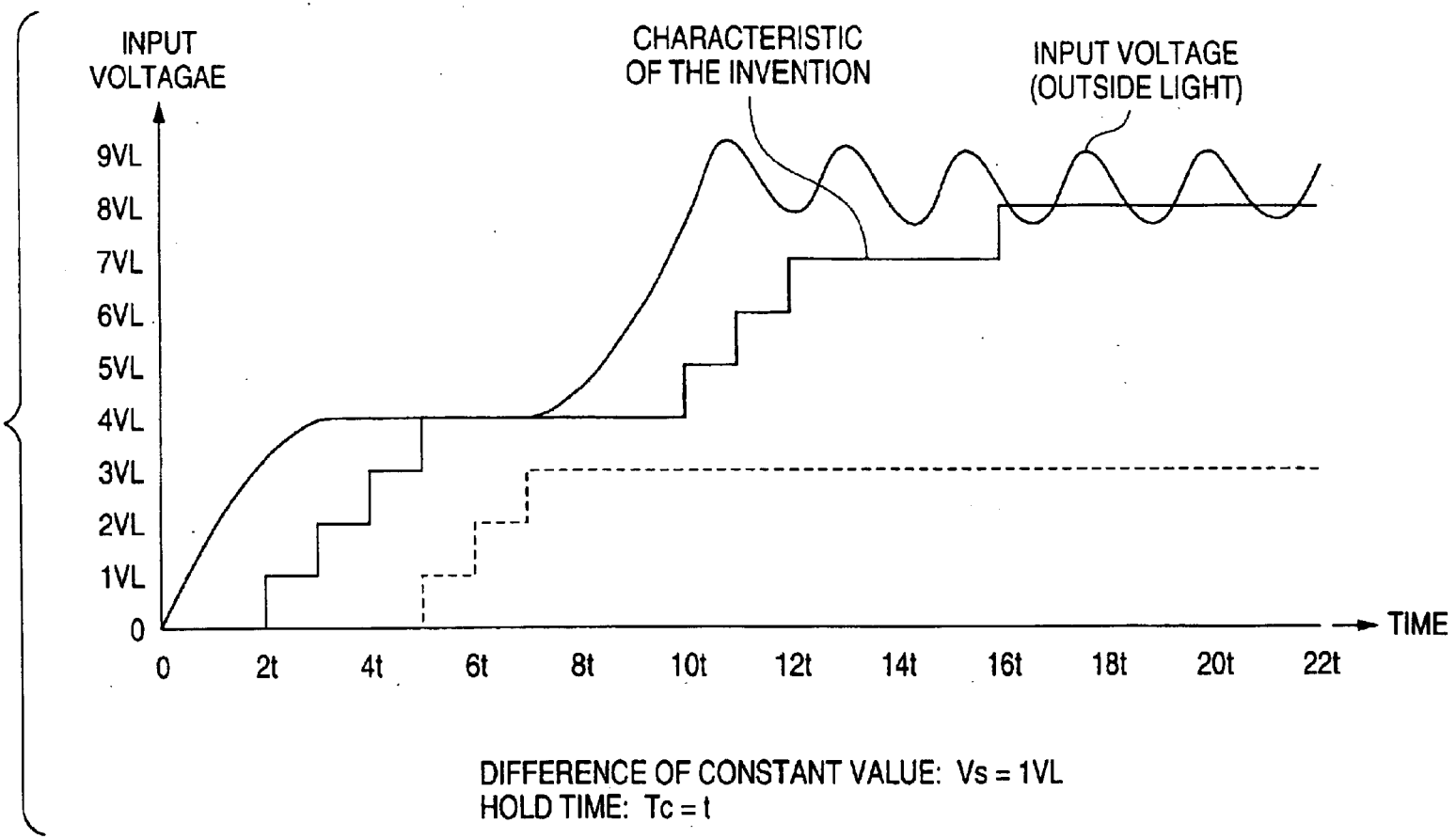
FIG. 4 is a chart to show an intensity adjustment characteristic when outside light is a constant value or more and changes unstably in a second embodiment of the invention.

Next, a second embodiment of the invention will be discussed. FIG. 4 is an intensity adjustment characteristic chart applied when outside light is a constant value or more and changes unstably. The solid line indicates a characteristic chart of the second embodiment of the invention and the dashed line indicates a characteristic chart applied when outside light changes only at constant time. In the embodiment, although the outside light is a constant value or more and is not stabilized, if difference of a constant value or more from the case of no outside light, Vs, is held for a constant time T1, one-step change is made (if the outside light is unstable). As indicated by the dashed line in the figure, if the outside light is a constant value or more and is not stabilized, the value may be maintained with no change.

Thus, if the outside light is a constant value or more and changes unstably, the intensity is controlled, whereby it is made possible to provide good display intensity if the outside light is unstable with a voltage value to such an extent that no effect is produced.

Next, a third embodiment of the invention will be discussed.

Figure 5:
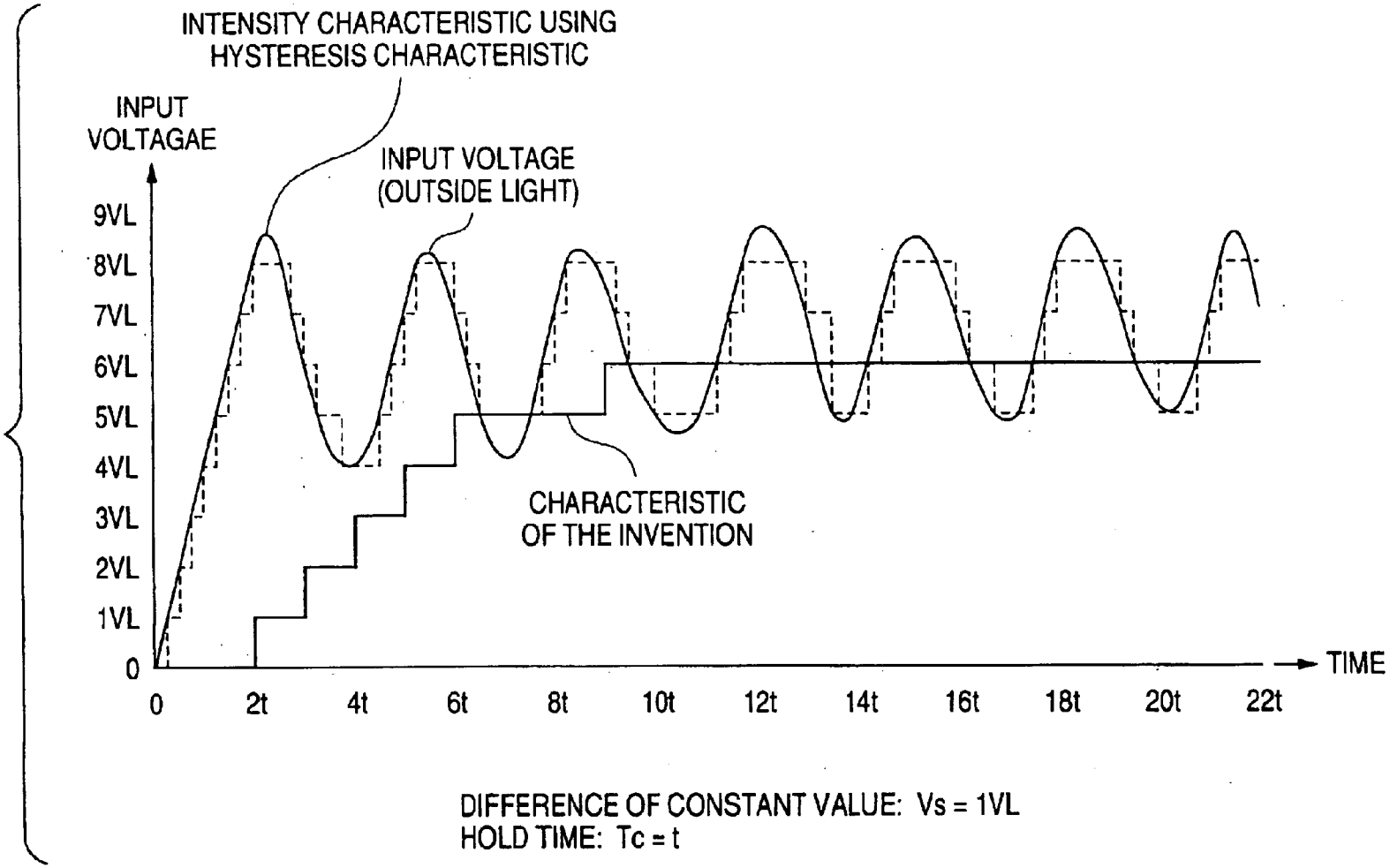
FIG. 5 is a chart to show an intensity adjustment characteristic when outside light changes intermittently in a second embodiment of the invention.

The embodiment is characterized by the fact that intensity adjustment is made for absorbing intermittent change in outside light only if the change amount of the outside light is a constant value held for a constant time. FIG. 5 is an intensity adjustment characteristic chart applied when outside light changes intermittently. The solid line indicates a characteristic chart of the invention and the dashed line indicates an intensity characteristic chart using a hysteresis characteristic (related art). If difference of a constant value or more, Vs, is not held for a constant time T1, the intensity is not changed and the preceding value is held. Thus, if the outside light is not stabilized, the intensity is held, whereby it is made possible to absorb intermittent change in the outside light caused by a handrail, etc.

In the embodiment, data is set in the memory 60, whereby both the read period T and the hold time Tc are made variable depending on the use environment, but the invention is not limited to it. For example, to use such a display indoors, only the read period T may be adjusted without absorbing intermittent change by setting the hold time Tc.

Further, only absorbing of intermittent change by setting the hold time Tc may be performed with the read period T fixed.

Figure 6:
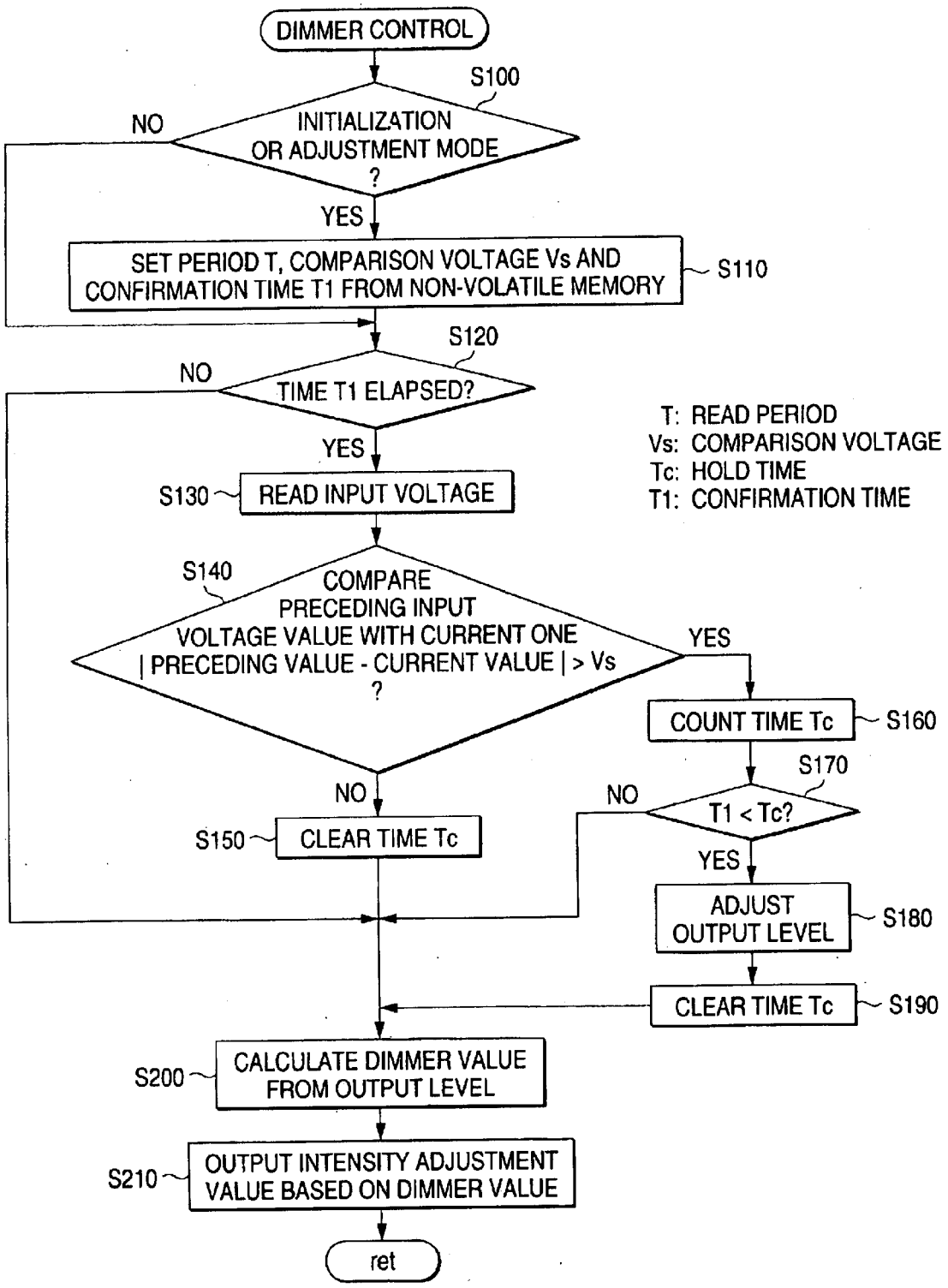
FIG. 6 is a flowchart to show a method of a fourth embodiment of the invention.
Figure 7:
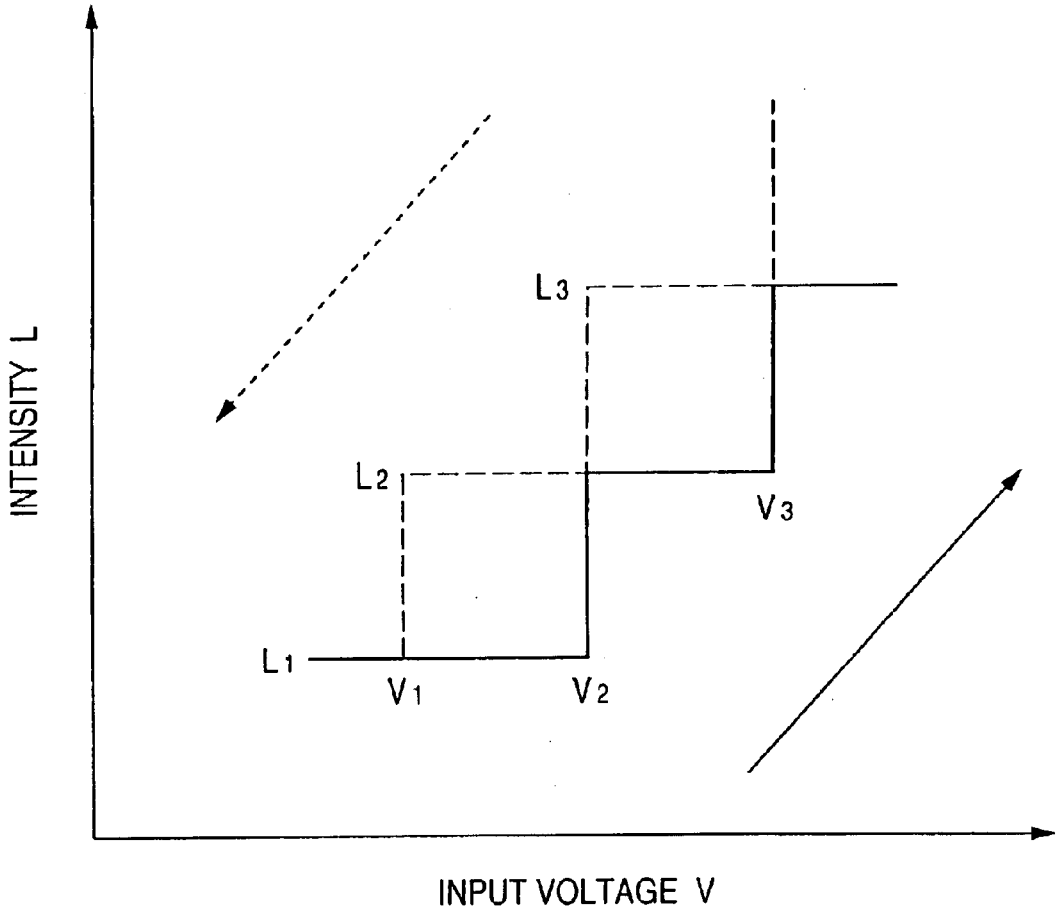
PRIOR ART FIG. 7
FIG. 7 is a schematic representation of the principle of a display method in a related art.

Next, a fourth embodiment of the invention will be discussed. In the embodiment, light amount change is previously measured in various environmental conditions, the best conditions of reference period T, comparison voltage Vs determined by a voltage value provided by executing photoelectric conversion of the light amount change, hold time Tc, and confirmation time T1 are determined based on the measurement result, and the data is written into nonvolatile memory such as flash memory. FIG. 6 is a flowchart.

First, when the environmental conditions are input and set in an initialization or adjustment mode (step S100), the reference period T, the comparison voltage Vs, the hold time Tc, and the confirmation time T1 are read from the flash memory (step S110) and a measuring process is entered based on the read best conditions. The following steps are similar to step S120 and the later steps previously described with reference to FIG. 2.

Thus, the number of measurement times and the number of adjustment times are reduced when unnecessary, and careful measurement is executed only if necessary. Thus, it is made possible to provide an easy-to-see and high-reliability display without increasing power consumption.

In the description of the embodiments, the display of the car navigation system is covered, but the invention can be applied to various displays such as other in-car displays and displays of portable telephones. It is not necessarily limited to displays installed in mobile units and can be applied to displays of clocks in parks, displays in airports, etc. The invention can be applied to various displays including liquid crystal displays, EL panels, etc.

As described above, according to the invention, the voltage read period is changed and the intensity adjustment speed relative to the outside light is adjusted, whereby variations in intensity adjustment speeds from one product to another can be adjusted.

When light amount change of outside light is not held a constant value or more for a constant time, even if the outside light changes, the preceding value of intensity is maintained, thereby absorbing intermittent change in the outside light caused by a handrail, etc.; a stable display image can be provided.

What is claimed is:

1. A display control method for adjusting an intensity of an image display in accordance with time change of outside light said display control method comprising the steps of:

detecting the light amount of the outside light; and adjusting the intensity in response to the detected light amount, wherein said detecting step comprises a processing step of changing the intensity only if light amount change of the outside light is held a constant value or more for a constant time, a duration of said constant time being variable and based on an external setting, the detecting step thereby absorbing intermittent changes in the outside light;

wherein said detecting step comprises the additional steps of:

a variable period setting step of further setting a read period.

2. A display control method for adjusting an intensity of an image display in accordance with time change of outside light, said display control method comprising the steps of:

detecting the light amount of the outside light; and adjusting the intensity in response to the detected light amount, wherein said detecting step comprises:

a variable period setting step of setting a read period, a duration of the read period being variable and based on an external setting; and a detecting step of detecting the light amount every period set at the setting step;

wherein said detecting step comprises the additional steps of:

the processing step of changing the intensity only if light amount change of the outside light is held a constant value or more for a constant time, thereby absorbing intermittent change in the outside light.

3. A display control method for adjusting an intensity of an image display in accordance with time change of outside light, said display control method comprising the steps of:

detecting the light amount of the outside light; and adjusting the intensity in response to the detected light amount, wherein said detecting step comprises:

a variable period setting step of setting a read period, a duration of the read period being variable and based on an external setting; and a detecting step of detecting the light amount every period set at the setting step;

wherein said detecting step comprises the additional step of executing photoelectric conversion of the light amount of the outside light to a voltage value and outputting the light amount as the voltage value.

4. A display control method for adjusting an intensity of an image display in accordance with time change of outside light, said display control method comprising the steps of:

detecting the light amount of the outside light; and adjusting the intensity in response to the detected light amount, wherein said detecting step comprises:

a variable period setting step of setting a read period, a duration of the read period being variable and based on an external setting; and a detecting step of detecting the light amount every period set at the setting step;

wherein said variable period setting step is to read data from among data stored in a storage unit and set the read data as the read period.

5. A display control method for adjusting an intensity of an image display in accordance with time change of outside light said display control method comprising the steps of:

detecting the light amount of the outside light; and adjusting the intensity in response to the detected light amount, wherein said detecting step comprises a processing step of changing the intensity only if light amount change of the outside light is held a constant value or more for a constant time, a duration of said constant time being variable and based on an external setting, the detecting step thereby absorbing intermittent changes in the outside light;

wherein said detecting step comprises the additional step of executing photoelectric conversion of the light amount of the outside light to a voltage value and outputting the light amount as the voltage value.

6. A display control method for adjusting an intensity of an image display in accordance with time change of outside light said display control method comprising the steps of:

detecting the light amount of the outside light; and adjusting the intensity in response to the detected light amount, wherein said detecting step comprises a processing step of changing the intensity only if light amount change of the outside light is held a constant value or more for a constant time, a duration of said constant time being variable and based on an external setting, the detecting step thereby absorbing intermittent changes in the outside light;

wherein said variable period setting step is to read data from among data stored in a storage unit and set the read data as the read period.

7. A display control method for adjusting an intensity of an image display in accordance with time change of outside light said display control method comprising the steps of:

detecting the light amount of the outside light; and adjusting the intensity in response to the detected light amount, wherein said detecting step comprises a processing step of changing the intensity only if light amount change of the outside light is held a constant value or more for a constant time, a duration of said constant time being variable and based on an external setting, the detecting step thereby absorbing intermittent changes in the outside light;

wherein the display is an in-car display.

8. A display controller comprising:

variable period setting means for allowing an operator to set a read period, a duration of the read period being variable and based on an external setting;

detection means for detecting a light amount of outside light every setup read period; and intensity adjustment means for adjusting intensity of a display in response to the detected light amount of outside light;

wherein said intensity adjustment means adjusts the intensity only if light amount change of the outside light is held a constant value or more for a constant time, thereby absorbing intermittent change in the outside light.

9. A display controller comprising:

variable period setting means for allowing an operator to set a read period, a duration of the read period being variable and based on an external setting;

detection means for detecting a light amount of outside light every setup read period; and intensity adjustment means for adjusting intensity of a display in response to the detected light amount of outside light;

wherein said variable period setting means comprises a photoelectric conversion of the light amount of the outside light to a voltage value and outputting the light amount as the voltage value.

10. A display controller comprising:

variable period setting means for allowing an operator to set a read period, a duration of the read period being variable and based on an external setting;

detection means for detecting a light amount of outside light every setup read period; and intensity adjustment means for adjusting intensity of a display in response to the detected light amount of outside light;

wherein said variable period setting means comprises a storage unit and set the read data as the read period.

11. A display controller comprising:

variable period setting means for allowing an operator to set a read period, a duration of the read period being variable and based on an external setting;

detection means for detecting a light amount of outside light every setup read period; and intensity adjustment means for adjusting intensity of a display in response to the detected light amount of outside light;

wherein said display is an in-car display.

* * * * *